US011060330B2

(12) United States Patent
Marsden

(10) Patent No.: US 11,060,330 B2
(45) Date of Patent: Jul. 13, 2021

(54) TETHER LOCK

(71) Applicant: Elbee Pty Ltd., Bondi Junction (AU)

(72) Inventor: Andrew Marsden, Hingham, MA (US)

(73) Assignee: Elbee Pty Ltd., Bondi Junction (AU)

( * ) Notice: Subject to any disclaimer, the term of this patent is extended or adjusted under 35 U.S.C. 154(b) by 452 days.

(21) Appl. No.: 15/980,402

(22) Filed: May 15, 2018

(65) Prior Publication Data

US 2019/0352948 A1 Nov. 21, 2019

(51) Int. Cl.

| | |
|---|---|
| ***E05C 17/52*** | (2006.01) |
| ***E05C 17/48*** | (2006.01) |
| ***E05D 1/04*** | (2006.01) |

(52) U.S. Cl.

CPC ..... *E05C 17/52* (2013.01); *E05C 17/48* (2013.01); *E05D 1/04* (2013.01);

(Continued)

(58) Field of Classification Search

CPC ..... E05C 17/52; E05B 13/007; E05B 73/00; E05B 13/105; E05B 65/0014; E05B 19/0047; E05B 29/0033; E05B 17/04; E05B 27/083; E05B 29/0066; E05B 27/08; E05B 35/008; E05B 65/0864; E05B 11/00; E05B 13/005; E05B 13/10; E05B 15/0053; E05B 15/0205; E05B 15/022; E05B 15/143; E05B 17/2034; E05B 17/2038; E05B 17/2092; E05B 19/00; E05B 19/14; E05B 2015/0406; E05B 2027/0025; E05B 2047/0037; E05B 2047/0092; E05B 2047/0093; E05B 27/001; E05B 27/0032; E05B 27/0078; E05B 27/0082; E05B 29/0006; E05B 29/0013; E05B 29/0026; E05B 31/00; E05B 35/08;

(Continued)

(56) References Cited

U.S. PATENT DOCUMENTS

| | | | |
|---|---|---|---|
| 795,882 | A | 8/1905 | Atkin |
| 2,105,714 | A | 1/1938 | West |

(Continued)

FOREIGN PATENT DOCUMENTS

| | | | | |
|---|---|---|---|---|
| CN | 203412419 | U | 1/2014 | |
| EP | 2418343 | A2 * | 2/2012 | ..... E05C 17/365 |

(Continued)

OTHER PUBLICATIONS

International Search Report and Written Opinion for International Application No. PCT/AU2016/000309, dated Nov. 4, 2016.

(Continued)

*Primary Examiner* — Kristina R Fulton
*Assistant Examiner* — James Edward Ignaczewski
(74) *Attorney, Agent, or Firm* — Wolf, Greenfield & Sacks, P.C.

(57) ABSTRACT

A lock for an access point such as a window includes a dual-action locking mechanism with a locking unit and a blocker. The locking unit is movable between a locking position and an unlocking position. The blocker blocks movement of the locking unit when the blocker is in a blocking position, and permits movement of the locking unit when the blocker is in an unblocking position. The lock may capture an insert attached to a tether to permit partial opening of a window while the unit is locked.

32 Claims, 12 Drawing Sheets

(52) U.S. Cl.
CPC ... *E05Y 2201/264* (2013.01); *E05Y 2201/266* (2013.01); *E05Y 2201/408* (2013.01); *E05Y 2900/148* (2013.01)

(58) Field of Classification Search
CPC .. E05B 35/14; E05B 47/0004; E05B 47/0603; E05B 49/00; E05B 55/005; E05B 63/16; E05B 63/18; E05B 65/0082; E05B 65/08; E05B 65/0841; E05B 65/0852; E05B 65/1033; E05B 65/5284; E05B 67/02; E05B 67/24; E05B 73/0005; E05B 73/0082; E05B 9/086; Y10T 70/5164; E05D 1/04; E05D 11/1028; E06B 3/325; E06B 3/36; E06B 1/36; E06B 3/34; E06B 5/10
See application file for complete search history.

(56) References Cited

U.S. PATENT DOCUMENTS

| | | | | |
|---|---|---|---|---|
| 2,867,468 | A | 1/1959 | Bugge | |
| 2,966,053 | A | 12/1960 | Mintz | |
| 3,101,603 | A | 8/1963 | North et al. | |
| 3,125,875 | A | 3/1964 | Friedman | |
| 3,524,335 | A | 8/1970 | George | |
| 3,631,896 | A | 1/1972 | Meigs | |
| 3,640,106 | A | 2/1972 | Lorincz | |
| 3,971,242 | A | 7/1976 | Mikos | |
| 4,105,231 | A | 8/1978 | Huyssen | |
| 4,472,143 | A | 9/1984 | Bennett et al. | |
| 5,669,256 | A | 9/1997 | Chung | |
| 6,419,258 | B1 | 7/2002 | Grote | |
| 6,694,788 | B1 | 2/2004 | Hsieh | |
| 9,890,571 | B1 | 2/2018 | Marsden | |
| 2006/0236732 | A1* | 10/2006 | Hoffman | E05C 3/042 70/127 |
| 2006/0243006 | A1* | 11/2006 | Christensen | E05B 15/143 70/58 |
| 2007/0113608 | A1 | 5/2007 | Andres | |
| 2011/0173895 | A1 | 7/2011 | Lund | |
| 2016/0130830 | A1* | 5/2016 | Magiera | E04H 9/14 109/1 S |
| 2017/0058580 | A1 | 3/2017 | Marsden | |

FOREIGN PATENT DOCUMENTS

| | | | | |
|---|---|---|---|---|
| EP | 2 418 343 | B1 | 9/2016 | |
| EP | 3 228 789 | A1 | 10/2017 | |
| EP | 3228789 | A1 * | 10/2017 | E05C 17/365 |
| EP | 3 034 729 | B1 | 11/2017 | |
| GB | 995 017 | A | 6/1965 | |
| GB | 2 407 615 | B | 8/2006 | |
| GB | 2 441 176 | A | 2/2008 | |
| GB | 2 527 920 | A | 1/2016 | |
| GB | 2 508 986 | B | 12/2019 | |
| WO | WO 2014/108680 | A1 | 7/2014 | |
| WO | WO-2014108680 | A1 * | 7/2014 | E05B 65/0014 |
| WO | WO 2017/160261 | A1 | 9/2017 | |
| WO | WO-2017160261 | A1 * | 9/2017 | E05C 17/365 |
| WO | WO 2019/161973 | A1 | 8/2019 | |
| WO | WO-2019161973 | A1 * | 8/2019 | E05C 17/365 |

OTHER PUBLICATIONS

International Search Report and Written Opinion for International Application No. PCT/AU2019/000056, dated Jul. 5, 2019.

* cited by examiner

TETHER LOCK

FIELD

Disclosed embodiments are related to tether locks for securing access points.

BACKGROUND

Traditionally, access points (e.g., doors, windows, etc.) for buildings have been secured with latches. That is, a latch extends from a moveable component of the access point (e.g., opening window or swinging door) into a stationary component (e.g., a frame or window sill) or vice versa. These conventional latching locks are generally operated with a key in a single motion to lock or unlock the access point. In some cases, it may be desirable to maintain the security of an access point while still allowing some movement of the moveable component. In this case, a tether lock or chain lock is traditionally used. Conventional tether locks include a flexible component which extends between the moveable and stationary components of the access point such that the moveable component may be partially moveable without forfeiting security of the access point. These conventional tether locks generally use a key in a single motion to lock or unlock the access point.

SUMMARY

According to one embodiment, a window lock includes a rotatable locking unit constructed and arranged to rotate between a locking position and an unlocking position, a blocker having a blocking surface which is configured to prevent rotation of the locking unit from the locking position to the unlocking position when the blocker is in a blocking position, and a key that is axially insertable into the locking unit. The key is constructed and arranged to travel within the locking unit in an axial direction of the key and apply a force to the blocker in the axial direction to push the blocker out of the blocking position. With the blocker out of the blocking position, the blocking surface is not positioned to prevent rotation of the locking unit from the locking position to the unlocking position. The key and the locking unit are adapted such that rotation of the key rotates the locking unit.

According to another embodiment, a lock includes a locking unit constructed and arranged to move between a locking position and an unlocking position, a blocker positioned on a bending member, and a key constructed and arranged to be inserted into the locking unit. The blocker has a blocking surface which is configured to prevent movement of the locking unit from the locking position to the unlocking position when the blocker is in a blocking position. The key is constructed and arranged to push at least one of the blocker and bending member to bend the bending member and move the blocker out of the blocking position.

According to a further embodiment, a window lock has a locking unit moveable between a locking position and an unlocking position and a blocker having a blocking surface which is configured to prevent movement of the locking unit from the locking position to the unlocking position when the blocker is in a blocking position. A method of operating the window lock includes inserting a key in an axial direction into the locking unit, applying a force in the axial direction to the blocker to move the blocker out of the blocking position, and rotating the key to move the locking unit from a locking position to an unlocking position.

According to another embodiment, a method of manufacturing a window lock includes injection molding a housing, injection molding a locking unit including a locking projection, a blocking recess, and an internal channel, injection molding a base including a blocker having a shape complementary to the blocking recess, injection molding a key including an insertion end having a shape complementary to the internal channel, placing the locking unit on the base, such that the blocker is received by the blocking recess, and connecting the base and the housing such that the locking unit is disposed between the base and the housing.

According to yet another embodiment, a window lock includes a rotatable locking unit constructed and arranged to rotate between a locking position and an unlocking position, and a blocker having a blocking surface which is configured to prevent rotation of the locking unit from the locking position to the unlocking position when the blocker is in a blocking position. The window lock also includes a key including a retaining channel that is insertable into the locking unit. The key is constructed and arranged to apply a force to the blocker to move the blocker out of the blocking position. With the blocker out of the blocking position, the blocking surface is not positioned to prevent rotation of the locking unit from the locking position to the unlocking position. The key and the locking unit are adapted such that rotation of the key rotates the locking unit, and the retaining channel retains the key in the locking unit when the locking unit is in the unlocking position.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1:
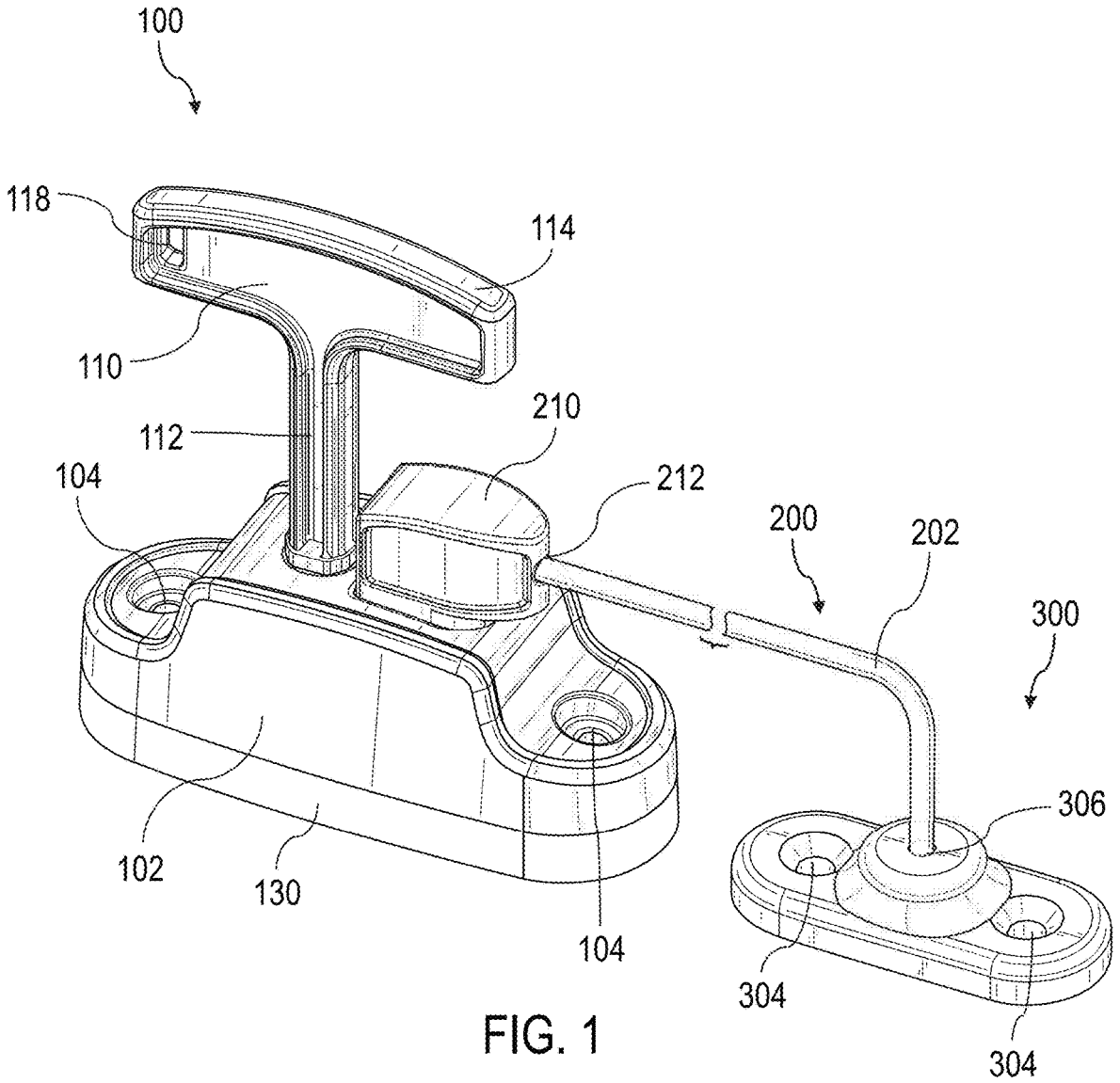
FIG. 1 is a perspective view of one embodiment of a lock, tether, and anchor.
Figure 2:
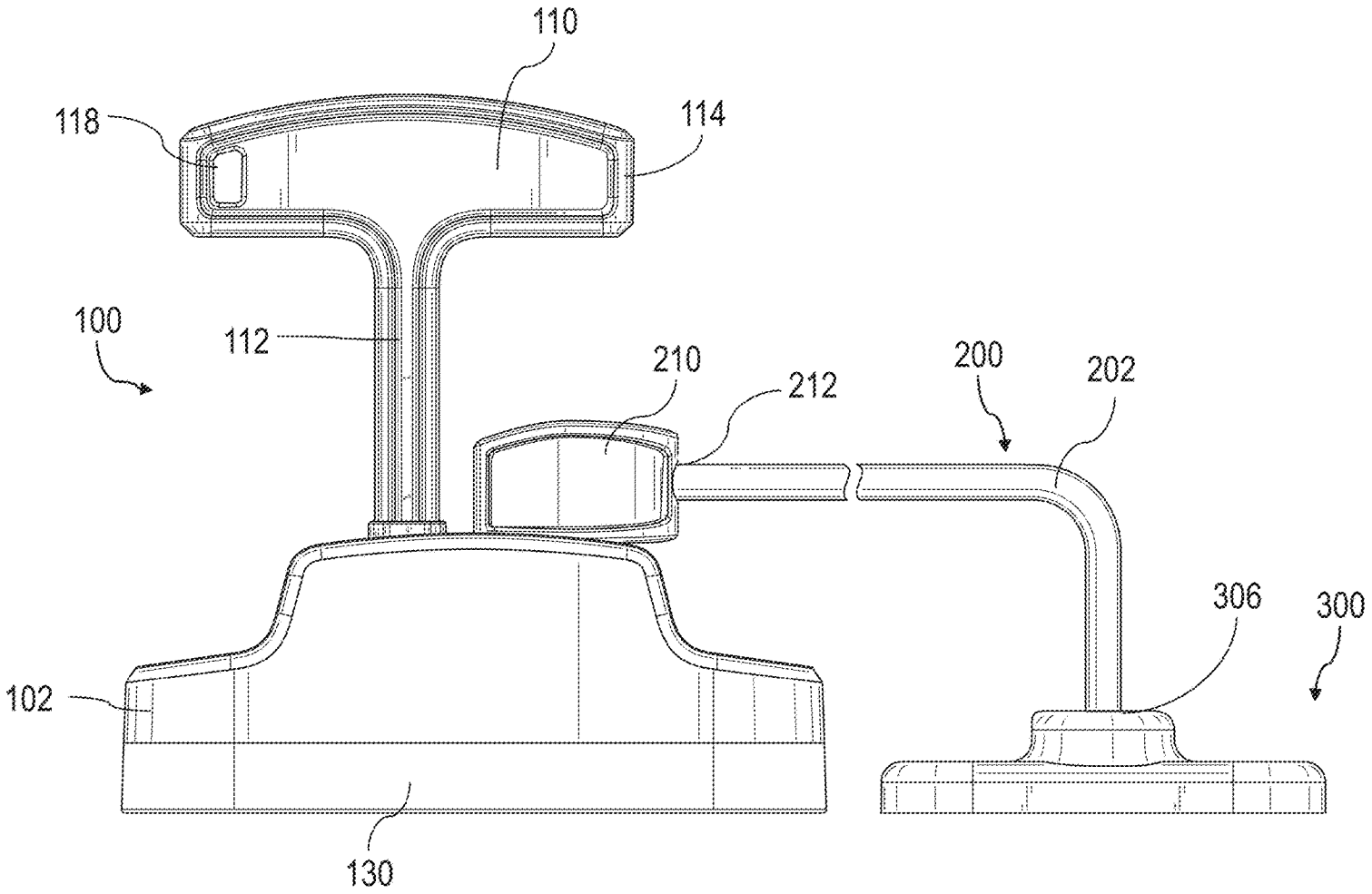
FIG. 2 is a front view of the lock, tether, and anchor of FIG. 1.
Figure 3:
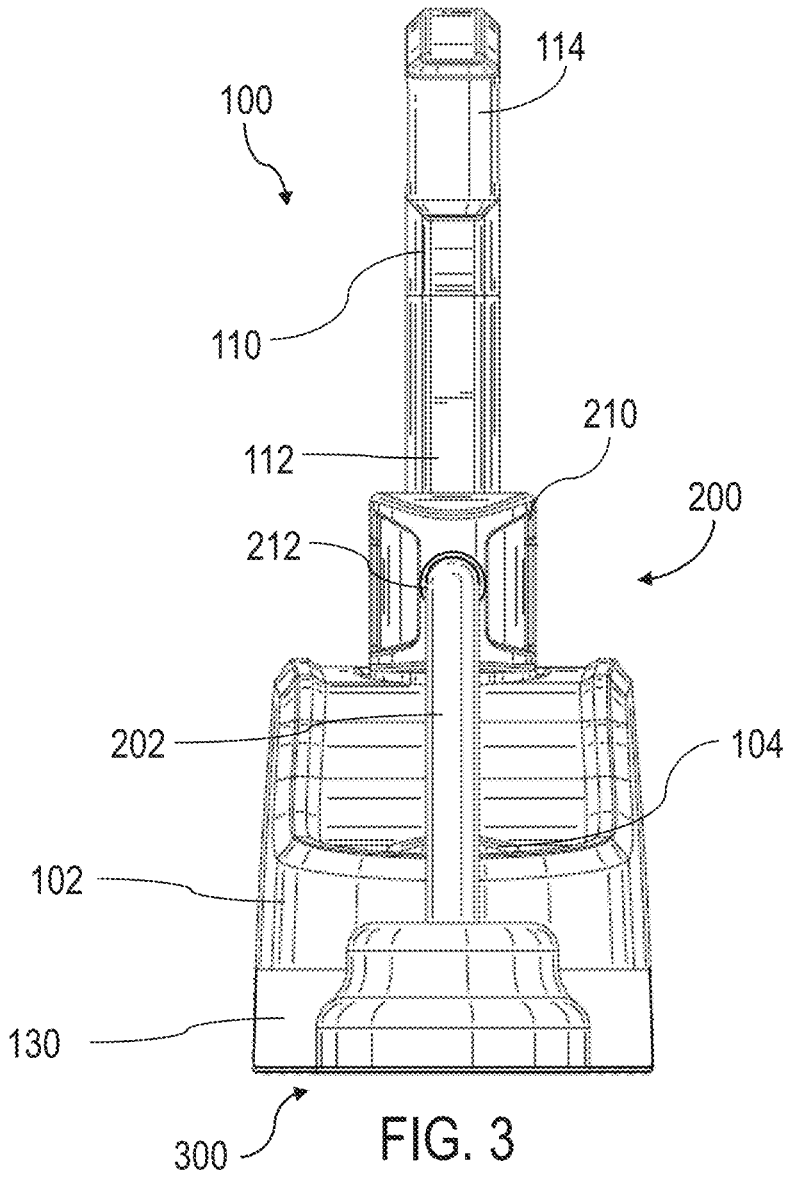
FIG. 3 is a side view of the lock, tether, and anchor of FIG. 1.
Figure 4:
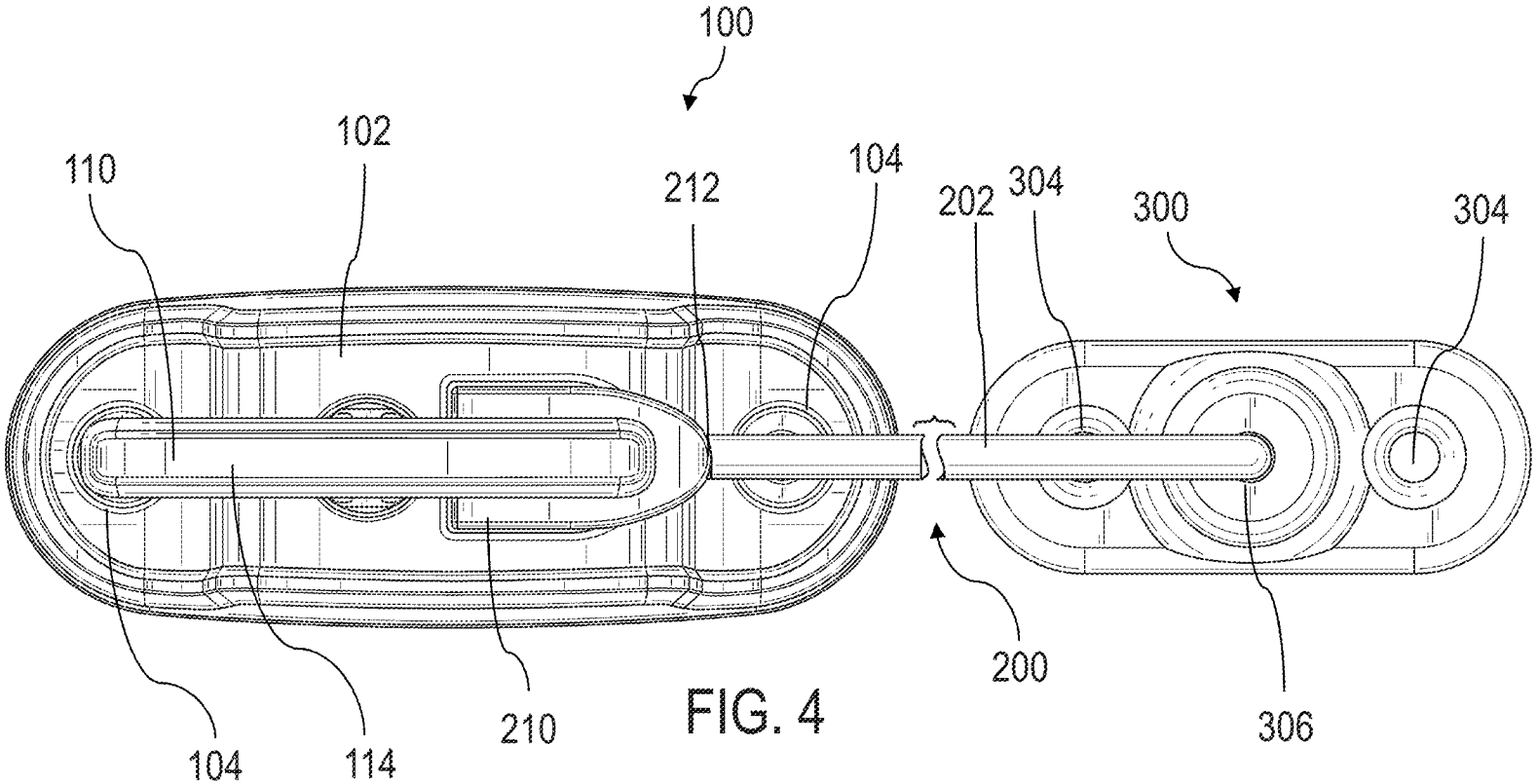
FIG. 4 is a top view of the lock, tether, and anchor of FIG. 1.

Conventional locks for access points traditionally use a key which interfaces with a lock tumbler to unlock the access point. Accordingly, conventional locks are single-action locks, where a simple rotational motion of the key will unlock the lock. In cases where children are near locked access points, it may be desirable to increase the complexity of the unlocking action to prevent operation of the lock by a child. A dual-action lock may impede operation of the lock by a child. That is, a dual-action lock which takes two positive steps (e.g., steps where force is applied by an operator in different directions) to open the lock may impede operation by a child. Traditionally, dual-action child safety locks are latching locks, and don't allow for any partial movement of the access point. In many cases, it may be desirable to keep an access point locked while allowing partial movement of a moveable component of the access point. For example, ventilation through a window, or communication through a partially open door may be desirable without forfeiting the security of the access point.

In some cases, it is desirable for a lock to have a locking mechanism which is easy for an adult to use, but difficult for a child. Many conventional dual-action child safety locks are difficult to operate for both children and adults. Additionally, it is often desirable for a child safety lock to include robust components, such that the lock does not wear out with repeated use which may be common for access points around children.

In view of the above, the inventors have recognized the benefits of a lock for an access point which includes a key and a simplified multi-action locking mechanism. The lock selectively receives and secures a tether, such that in some embodiments an access point (e.g., a window or door) may be partially opened without compromising the security of the access point. The locking mechanism is both easy to use for adults and robust for high use access points.

According to one aspect, a lock includes a locking unit, a key, and a blocker. The locking unit is moveable between a locking position and an unlocking position, and is adapted to receive the key. The locking unit also includes an internal channel defined by an outer perimeter. The key includes a handle and a shaft with an insertion end. The insertion end has an external surface which complements the shape of the internal channel, such that the locking unit receives the insertion end of the key, and force may be transmitted between the key and the locking unit.

The blocker is arranged to engage the locking unit and selectively control the ability of the locking unit to move. That is, in a blocking position the blocker is configured to prevent movement of the locking unit. Accordingly, when the key is initially received by the locking unit, the key cannot be turned to move the locking unit between the locking and unlocking positions. In an unblocking position, the blocking unit allows movement of the locking unit. That is, when the blocker is in the unblocking position, the key may be turned to move the locking unit between the locking and unlocking positions. The blocker may be moved between the blocking and unblocking positions with the key by application of a force in a different direction than the movement direction of the locking unit. In some embodiments, the key may be used to apply an axial force (i.e., force along a longitudinal direction of the key) to the blocker to move the blocker from the blocking position to the unblocking position. Once the blocker has been moved to the unblocking position, the key can turn the locking unit.

According to another aspect, a key may include three or more faces on an outer circumference. As discussed previously, the key may include an insertion end, a shaft, and a handle. The insertion end may have an outer circumference with a shape that corresponds to the shape of an outer perimeter of an internal channel of a locking unit. Such an arrangement may improve force transmission between the key and locking unit, as well as hinder insertion of objects into the locking unit other than the key to operate the lock. In some embodiments, the insertion end may include three or more faces along an outer circumference of the insertion end. For example, the insertion end may be constructed with three planar faces along the outer circumference that form a triangular shape. Of course, any suitable face or outer circumference shape may be used that is able to transmit force between the key and the locking unit, such as convex faces, concave faces, etc. In some embodiments, the three or more faces may form an outer circumference of both the insertion end and the shaft of the key. That is, the insertion end and shaft may have the same or substantially similar cross sectional shape that is received by the locking unit. By varying the complexity and number of faces on the key, the difficulty of operating the lock without the key may be increased.

According to another aspect, a blocker may be biased toward a blocking position in which the blocker engages a blocking recess on a locking unit to prevent movement of the locking unit between a locking position and an unlocking position. In some embodiments, the blocker may be disposed on a bendable member which is constructed and arranged to bend when the blocker is moved to an unblocking position. For example, the bendable member may be cantilevered and have the blocker disposed on an end of the bendable member that is furthest from a connection point of the cantilevered bendable member.

According to this embodiment, the blocker may be in a blocking position when the bending member is substantially straight (e.g., in a resting position) and may be in an unblocking position when the bending member is bent (e.g., in a flexed or stressed position). Thus, the bendable member acts as a biasing member which returns the blocker to the blocking position. The blocker may be biased toward the blocking position using any suitable biasing member such as coil springs, torsion springs, etc.

As discussed previously, the blocker may engage a locking unit in a blocking recess on a locking unit. The blocking recess may be formed with a shape complementary to that of the blocker, such that the blocker extends into the recess when the locking unit is in a locking position. In some embodiments, when the blocker is moved to the unblocking position and the locking unit is moved to the unlocking position, the locking unit may keep the blocker in the unblocking position. That is, the blocker may not impede rotation of the locking unit when the locking unit is in the unlocking position. Accordingly, an operator may move the locking unit to a locking position using a single action. In other embodiments, the blocker may move to the blocking position when the locking unit is in the unlocking position, such that dual-action operation is used even when the locking unit is moved from the unlocking position to the locking position.

According to another aspect, the lock may be adapted to receive and secure a tether. The tether may include a cable connected to an anchor on one end and an insert on an opposite end. The anchor may be constructed and arranged to be secured to a moveable portion of an access point (e.g., door, window, etc.). The insert may include a retaining portion which includes a recess and/or retaining projection. The recess and/or retaining projection are arranged to be selectively secured to the lock by a locking unit. The locking unit includes a locking projection which is adapted to engage the retaining portion of the insert to secure the tether to the lock when the locking unit is in a locking position. Accordingly, when the insert is received by the lock and secured by the locking unit in the locking position, the access point is secured. When the locking unit is moved to an unlocking position, the locking projection is moved out of engagement with the retaining portion, such that the insert is removable from the lock and the access point is unsecured.

In some embodiments, operating a lock includes both linear and rotational force application. For example, a locking unit may be arranged to rotate between a locking position and an unlocking position, and a blocker may be arranged to move substantially linearly between a blocking position and an unblocking position. That is, the blocker may be disposed on a bendable member which bends as a result of linear force, such that the blocker moves substantially linearly between the blocking and unblocking position. According to this example, a key inserted in the lock may be used to apply axial force (i.e., force along a longitudinal axis of the key) to the blocker to move the blocker from the blocking position to the unblocking position, and subsequently rotate the locking unit from a locking position to an unlocking position. Accordingly, the lock is dual-action as positive force is used in two different directions: longitudinal force on the blocker and torque on the locking unit. Of course, the locking unit and blocker may be arranged in any suitable position such that force is applied in two different directions to operate the lock.

In some embodiments, the lock may be multi-action where three or more distinct actions are used to operate the lock. For example, an additional button or latch may be included on the lock which is actuated in conjunction with applying axial force to the block and rotating the locking unit, such that force is applied to the lock in three different directions or along different axes. Any suitable arrangement for increasing the number of actions for operating the lock past two may be employed. In other embodiments, the lock may substantially single-action, where the operator may apply a force in one direction to lock and/or unlock the lock.

In some embodiments, the locking unit may include an internal channel which passes all the way through the locking unit, such that when a key is received in the internal channel the key may project out of both ends of the internal channel. Such an arrangement allows the key to interact with one or more additional locking structures on either side of the locking unit. For example, in embodiments where a blocker is positioned along an axis defined by the internal channel, the key may be able to engage both the blocker and the locking unit at the same time. In such embodiments, the key may be able to apply a longitudinal force to the blocker and a rotational force to the locking unit concurrently. Thus, the internal channel simplifies a dual-action mechanism by allowing a single piece (e.g., the key) to be used to perform both of the two actions. Of course, the internal channel may be used to allow the key to selectively engage any suitable number of locking components, such that one or more components may be engaged by the key simultaneously.

As discussed previously, the shape of the internal channel simplifies the dual-action mechanism while still impeding operation of the lock by a child. In traditional locks that use a conventional key, the key generally has a pattern that aligns with a tumbler mechanism to enable an operator to turn the key and unlock the lock. Such an arrangement is mechanically complex but doesn't require positive force application in at least two directions. The internal channel in the locking unit that allows the key to pass through and apply force to the blocker as well as transmit force to the locking unit simplifies the mechanical complexity of the lock while improving security of the lock around children. The internal channel may be shaped such that common household objects or the fingers of a child may not be inserted to apply force to at least one of the blocker and the locking unit. For example, a pen or other long cylindrical object could be inserted to apply force to the blocker, but would not be able to apply significant force to the locking unit to rotate the locking unit to the unlocking position. As another example, a finger of a child may be able to apply rotational force to the locking unit, but would not be able to reach the blocker through the internal channel to move the blocker to the unblocking position.

In some embodiments, a method of manufacturing a lock includes injection molding a locking unit, base, and housing for assembly. According to one embodiment, the locking unit may include a locking projection, a blocking recess, and an internal channel. The base includes a blocker having a shape complementary to the blocking recess. A key including an insertion end having a shape complementary to the internal channel may also be injection molded. After injection molding, the locking unit is placed on the base, such that the blocker is received by the blocking recess. The base is connected to the housing such that the locking unit is disposed between the base and the housing. In some embodiments, the base may be connected to the housing with a snap fit arrangement.

Locks as described herein may be applicable to a wide variety of access points where locking simplicity and multi-action is desirable, including, but not limited to, hinged windows, sliding windows, hinged doors, sliding doors, cabinets, and gates. Embodiments disclosed herein may be used with locks which do not include tethers. For example, in some embodiments, the locking unit may rotate to unlock a doorknob or release a catch that is not associated with a tether.

FIGS. 1-4 show one embodiment of lock 100, a tether 200 and an anchor 300. As shown in FIG. 1, the lock includes a housing 102, a key 110, and a base 130. The housing is connected to the base 130 and the key is fully inserted into a locking unit (not visible in FIGS. 1-4) disposed in the housing. The tether includes a cable 202 which is connected to an insert 210 at an insert anchor 212. The insert is constructed and arranged to be received by the housing and selectively secured by the locking unit. The cable is affixed to the anchor at an anchor clamp 306. The housing includes fastener holes 104 which are arranged to receive a fastener (e.g., screw, nail, etc.) to secure the lock to a portion of an access point. The anchor includes anchor fastener holes 304 which are similarly arranged to receive a fastener to secure the anchor to a portion of an access point. In some embodiments, the lock may be mounted to a non-moveable portion of an access point, and the anchor may be mounted to a moveable portion of the access point. In other embodiments, the lock may be mounted to a moveable portion of an access point and the anchor may be mounted to a non-moveable portion of the access point.

As shown in FIGS. 1-4, the insert 210 of the tether 200 is selectively secured in the housing 102 of the lock 100 through rotation of the key 110. The key includes a shaft 112, a handle 114, and an insertion end (not visible in FIGS. 1-4) for insertion into the housing. According to the depicted embodiment, an operator may push and then turn the handle to rotate the shaft and move the locking unit between a locking position and an unlocking position. In some embodiments, the handle may be turned approximately ninety degrees between the locking and unlocking positions. Of course, any suitable angle of rotation may be employed as the present disclosure is not so limited. The key also includes a hole 118 which may be used to connect the key to a key chain or any other key storage device.

Figure 5:
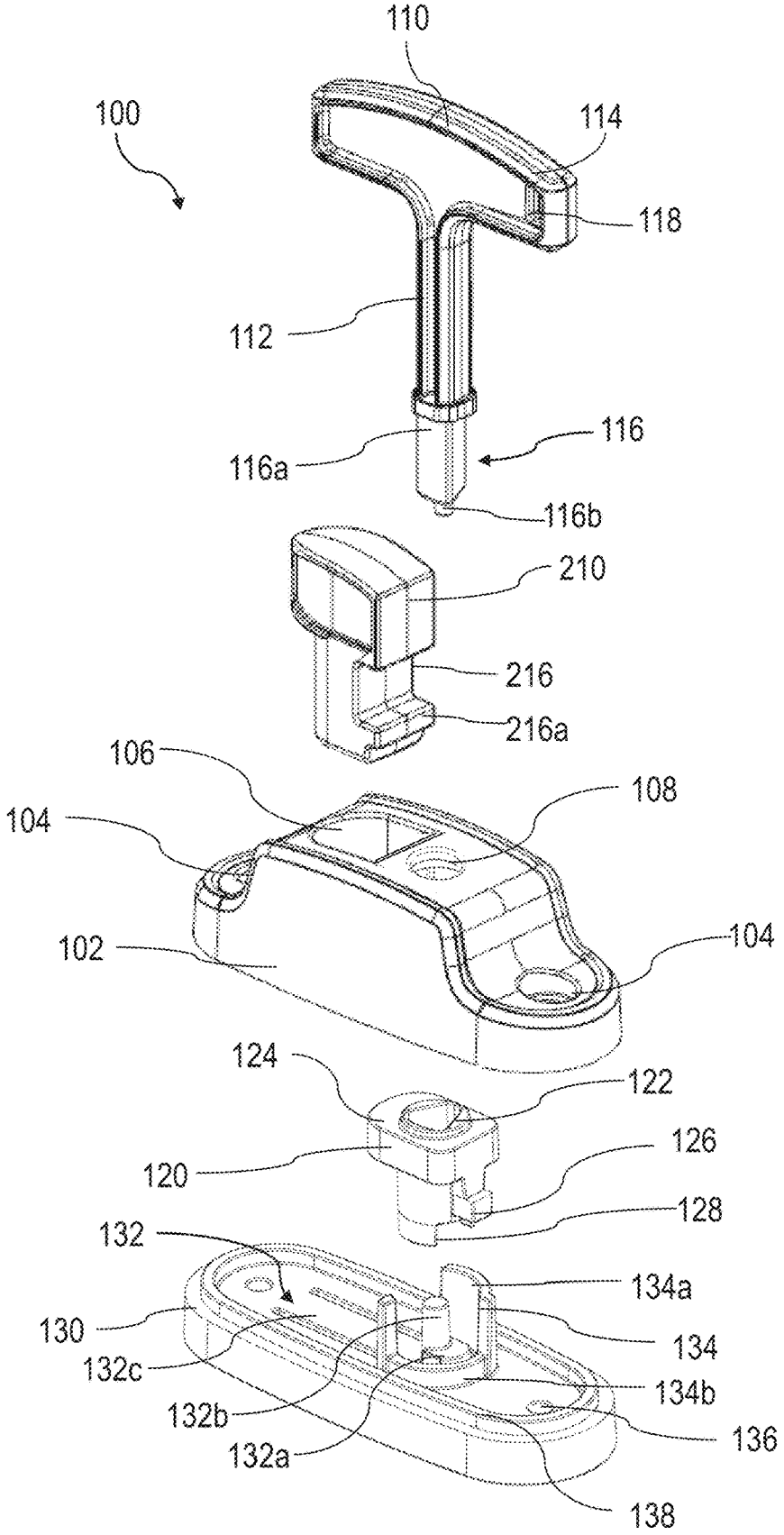
FIG. 5 is an exploded view of one embodiment of a lock and a tether insert.

FIG. 5 is an exploded view of one embodiment of a lock 100, a tether 200, and an anchor 300. The lock includes a dual-action locking mechanism including a locking unit 120 and a blocker 132. The locking unit 120 is formed as an independent piece relative to the housing 102 and the base 130, and the locking unit is moveable relative to the housing and the base. In the embodiment depicted in FIG. 5, the locking unit is constructed and arranged to rotate relative to the housing and base.

The locking unit 120 includes an internal channel 122, a locking projection 124, a guide 126 and a blocking recess 128. The internal channel is constructed and arranged to receive the key 110 and extends through the locking unit. More specifically, in some embodiments the internal channel has an outer surface adapted to complement the shape of an insertion end 116 of the key. The insertion end includes an outer surface 116*a* including one or more faces arranged to transmit force between the key and the locking unit. As shown in FIG. 5, the outer surface of the insertion end and the outer surface of the internal channel each include three faces, such that torque may be transmitted between the key and the locking unit. The insertion end also includes an end projection 116*b* constructed and arranged to transmit axial forces applied to the key.

The locking projection 124 is configured to selectively engage with a retaining portion 216 of the insert when the insert is inserted into a tether channel 106 in the housing 102. That is, the locking projection engages the retaining portion when the locking unit is in a locking position. According to the embodiment depicted in FIG. 5, the locking projection resists pulling force applied to the insert which may otherwise remove the insert. When the locking unit is rotated to the unlocking position, the locking projection disengages from the retaining portion such that the insert may be removed from the housing. The guide 126 is constructed and arranged to guide the locking unit as it moves from the locking position to the unlocking position. More specifically, the guide engages a guide wall 134 to support the locking unit as it rotates. The blocking recess 128 is configured to receive a blocker 132 which selectively permits the locking unit to be rotated.

As shown in FIG. 5, the base 130 of the lock 100 includes an integrally-formed blocker 132. The blocker includes a blocking projection 132*a*, a post 132*b*, and a bending member 132*c*. The blocking projection is constructed and arranged to be received by blocking recess 128 of the locking unit 120 in the resting position, as shown in FIG. 5. Accordingly, when the blocking projection is positioned in the blocking recess, the walls of the blocking recess abut the blocking projection and substantially prevent rotation of the locking unit from the locking position to the unlocking position. The post 132*b* is arranged to extend into the internal channel 122 of the locking unit. The post is arranged to receive force from the end projection 116*b* of the key 110. That is, the post receives axial force applied in the direction of the shaft 112 of the key when the insertion end is inserted into the internal channel. As force is applied to the post, the post transmits the force to the bending member 132*c* to bend the bending member and move the blocker 132 to an unblocking position. In the unblocking position, the blocking projection 132*a* is moved out of the blocking recess 128, such that the locking unit may be rotated from the locking position to the unlocking position.

According to the embodiment shown in FIG. 5, when the blocker 132 is in the unblocking position and the locking unit is moved to the unlocking position, the locking unit holds the blocker in the unblocking position. That is, the blocking projection abuts walls around the recess 128 such that the blocker is held in the unblocking position. Accordingly, the locking unit may be rotated from the unlocking position to the locking position using a single action (i.e., rotation) rather than a dual-action to simplify operation without any detrimental effects to security of the lock.

As shown in FIG. 5, the base 130 of the lock 100 includes a guide wall 134, mounting holes 136, and an attachment guide 138. The guide wall is arranged to receive the locking unit 120 and facilitates reliable movement of the locking unit between the locking position and the unlocking position. As shown in FIG. 5, the guide wall includes a high portion 134*a* and a low portion 134*b*. The low portion 134*b* is arranged to contact the locking unit guide 126, and the high portion 134*a* is arranged to support the locking unit on the locking unit sides to allow for consistent rotation of the locking unit between the locking portion and the unlocking position. The guide 126 of the locking unit also may serve as a rotation stop. According to the embodiment shown in FIG. 5, the locking unit is arranged to rotate approximately ninety degrees between the locking position and the unlocking position before the guide 126 contacts the high portion 134*a* to substantially prevent further rotation. In other embodiments, rotations of greater than or less than ninety degrees may be used. For example, in some embodiments, the locking unit may be arranged to rotate 180 degrees between the locking position and the unlocking position.

The mounting holes 136 are constructed and arranged to receive fasteners to secure the base of a portion of an access point. The mounting holes may also be used to secure the base to the housing 102 via fastener holes 104. The attachment guide 138 may be used to simplify alignment of the base 130 and the housing 102. That is, the attachment guide may fit into the housing such that the housing and base may be easily fastened together. In some embodiments, the attachment guide may be used to secure the base to the housing with a snap-fit arrangement.

Figure 6:
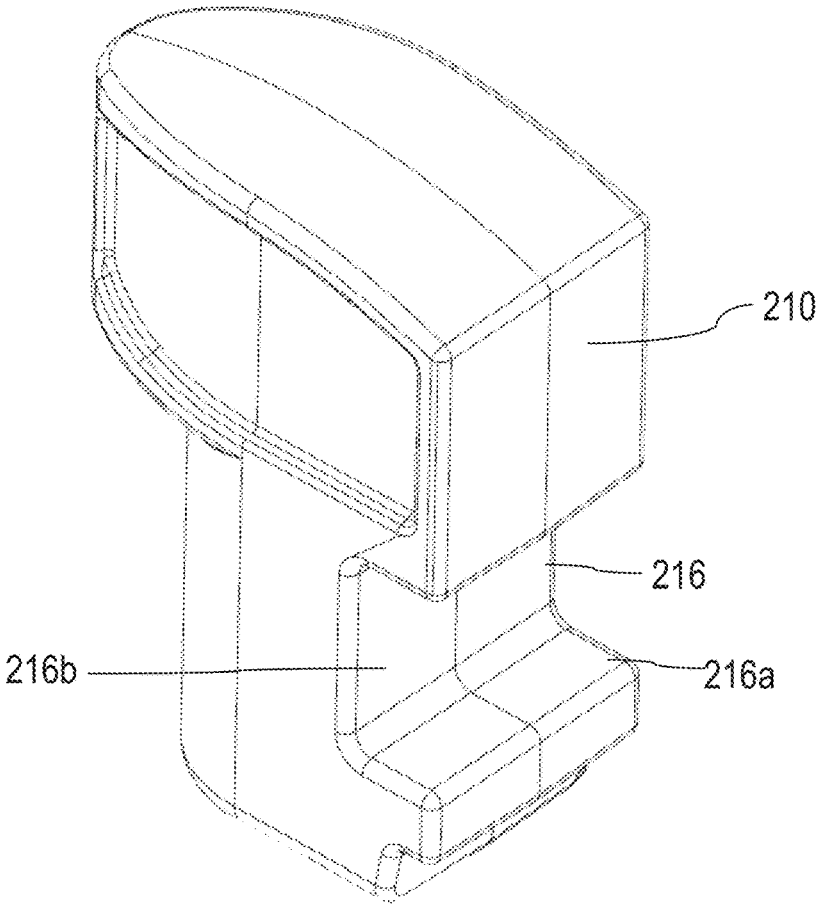
FIG. 6 is a perspective view of one embodiment for an insert for use with a tether and lock.
Figure 7:
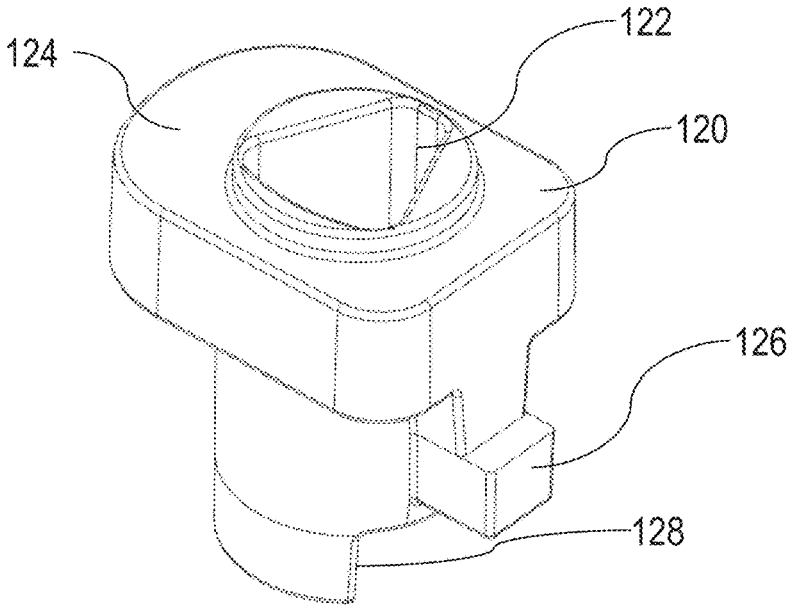
FIG. 7 is a perspective view of one embodiment of a locking unit.

FIG. 6 and FIG. 7 are perspective views of embodiments of a tether insert 210 and a locking unit 120, respectively. The tether insert includes retaining portion 216 which includes retaining projection 216*a* and retaining recess 216*b*. The locking unit includes internal channel 122 and locking projection 124. The locking projection is constructed and arranged to be received by the retaining portion 216 to secure the tether insert to the lock when the locking unit is in the locking position. That is, the locking projection fits into the retaining recess 216*b*, and the retaining projection 216*a* is arranged to contact the locking projection 124, which resists pulling forces on the insert that would otherwise remove the insert from the lock. When the locking unit is rotated to the unlocking position, the locking projection is moved out of the retaining portion such that pulling force applied to the insert removes the tether from the lock. The locking unit may be formed such that the retaining projection 216*a* does not contact the locking unit when the locking unit is in the unlocking position.

Figure 8:
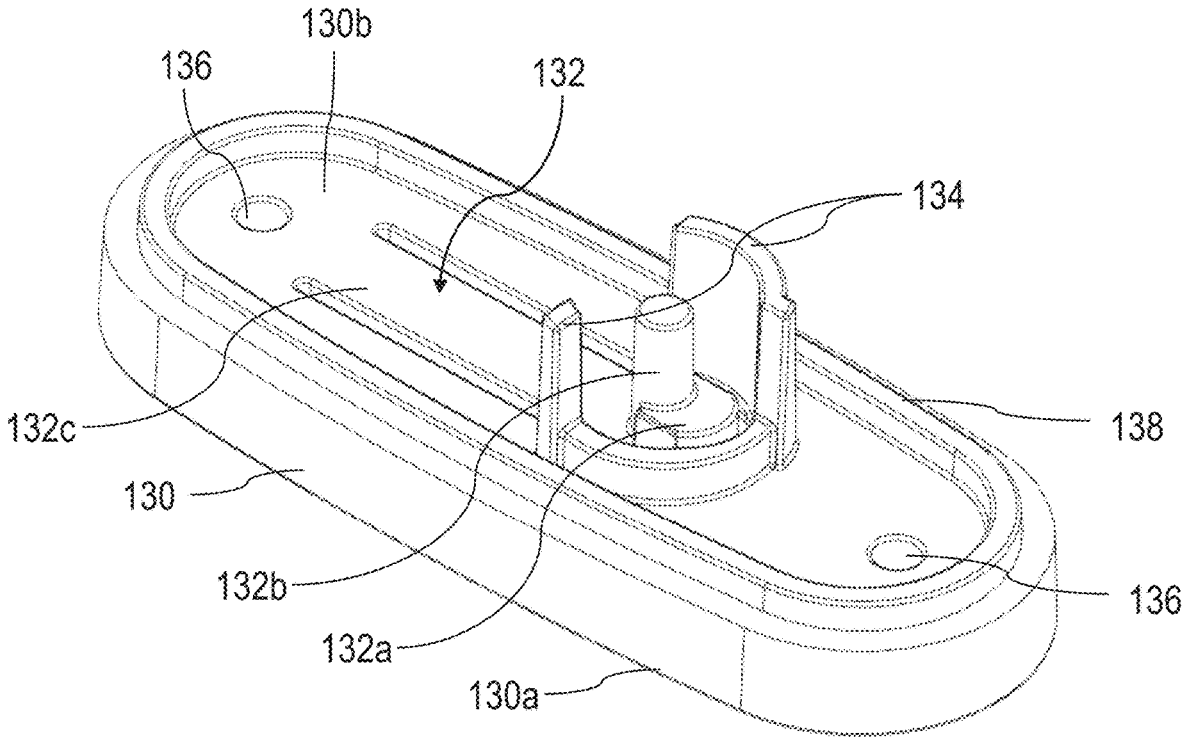
FIG. 8 is a perspective view of one embodiment of a base including a blocker and a bending member.
Figure 9:
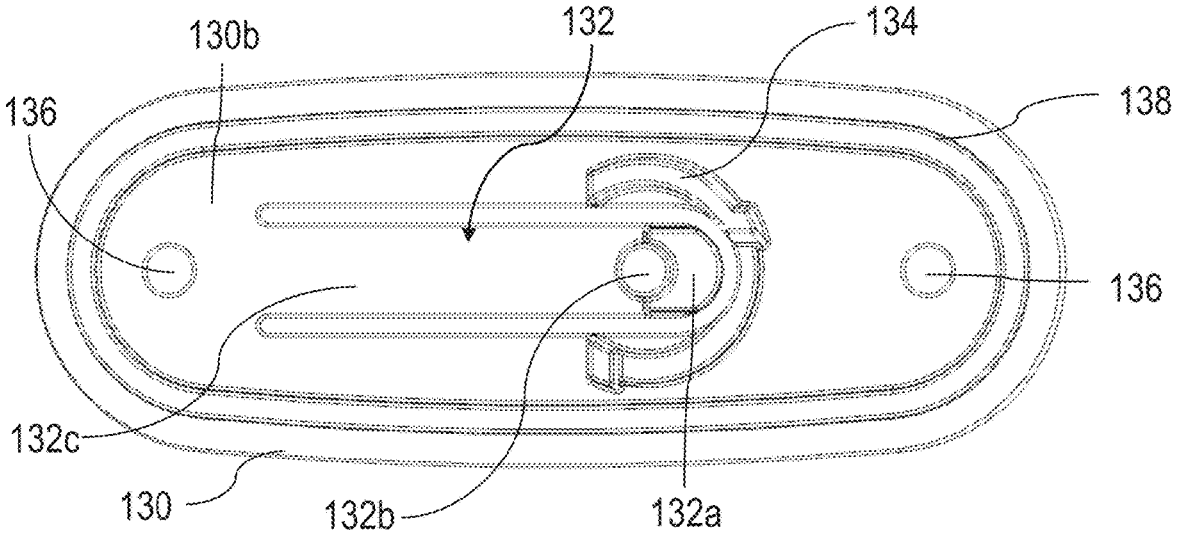
FIG. 9 is a top view of the base of FIG. 8.

FIGS. 8 and 9 are a perspective view and top view, respectively, of one embodiment of base 130 of a lock. The base 130 includes blocker 132 which includes a blocking projection 132*a* mounted on a bending member 132*c*. As best seen in FIG. 9, the bending member is cantilevered from the base, such that the bending member may be bent (e.g., flexed) to move the blocking projection 132*a* relative to the base. According to the embodiment shown in FIGS. 8-9, the blocker may be partially cut out from a top plate 130*b* of the base. The blocker 132 may be suspended above a lowermost portion 130*a* of the base such that the blocker may be bent toward the lowermost portion to move the blocker to the unblocking position. That is, there may be a suitable amount of space between the top plate 130*b* and the lowermost portion 130 such that the blocker may be bent towards the lowermost portion and disengage the blocking recess in the locking unit (not visible in FIGS. 8-9).

Figure 10:
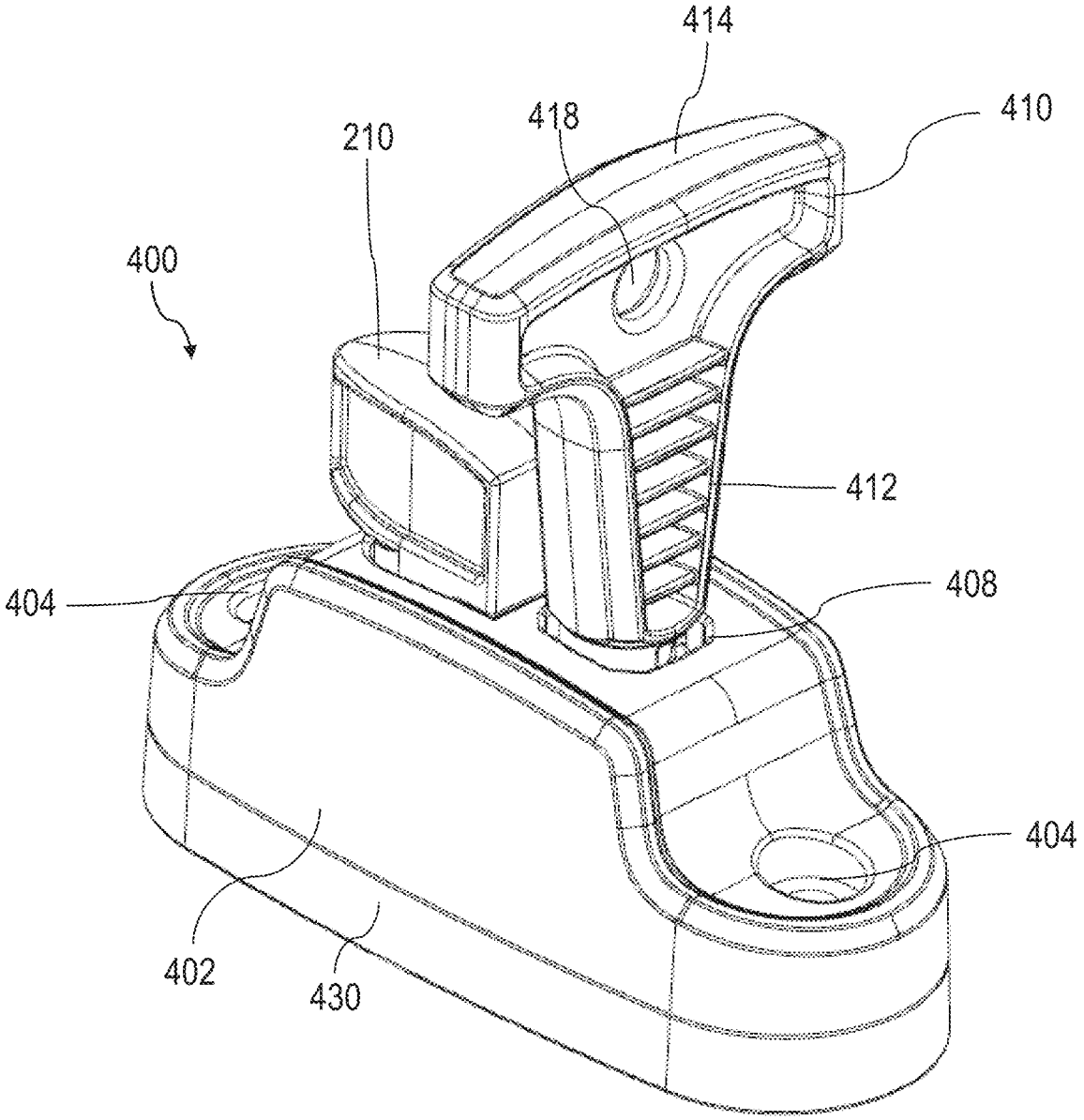
FIG. 10 is a perspective view of another embodiment of a lock and a tether insert.

FIG. 10 is a perspective view of another embodiment of a lock 400 and a tether insert 210. The lock includes a housing 402, a key 410, a locking unit (not visible in FIG. 10), and a base 430. The housing and the base are connected to one another and may be attached to an access point surface using fastener holes 404. The key is arranged to be received by the housing through an insertion channel 408. The key includes a shaft 412 and a handle 414 with a hole 418 formed therein Similar the embodiments discussed previously, the key 410 may be pushed and subsequently rotated to move the locking unit between a locking position and an unlocking position to secure or release the tether insert 210, respectively. According to the embodiment depicted in FIG. 10, the key 410 is in an unlocked position when a handle 414 of the key is perpendicular to a longitudinal axis of the housing 402.

Figure 11:
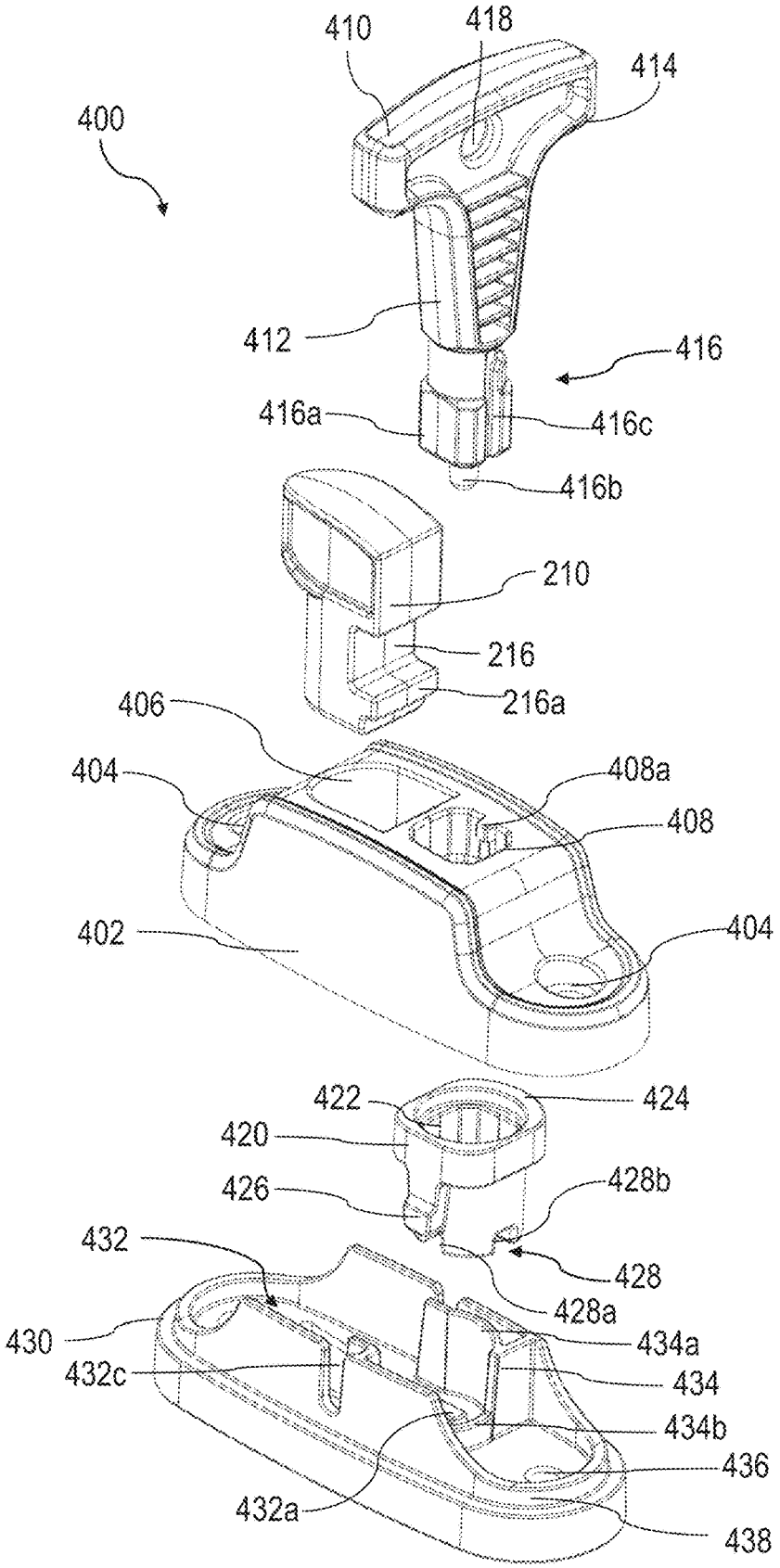
FIG. 11 is an exploded view of the lock and tether insert of FIG. 10.

FIG. 11 is an exploded view of the lock 400 and tether insert 210 shown in FIG. 10. The lock includes a dual-action locking mechanism having a locking unit 420 and a blocker 432. The locking unit 420 is formed as a separate piece relative to both the housing 402 and the base 430 in the illustrated embodiment. The locking unit is received by the base and the housing and is moveable relative to both the housing and base between a locking position where the tether insert is secured to the lock, and an unlocking position where the insert is released from the lock.

The locking unit 420 includes an internal channel 422, a locking projection 424, a guide 426, and a blocking recess 428. The internal channel is constructed and arranged to receive the key 410 and extends through the entire length of the locking unit. The internal channel complements the shape of an insertion end of the key 416 such that torque may be transmitted from the key to the locking unit. As shown in FIG. 11, an outer surface 416*a* of the insertion end 416 of the key 410 and the internal channel 422 of the locking unit 420 each have a square shape including four faces such that torque may be transmitted.

According to the embodiment shown in FIG. 11, the housing 402 includes an insertion channel 408. The insertion channel is similarly shaped to the insertion end 416 of the key 410 such that insertion of foreign objects (e.g., fingers, toys, etc.) into the lock may be hindered. The insertion channel 408 also includes a guide projection 408*a* which engages a guide channel 416*c* on the insertion end of the key. The guide projection may require the key to be inserted into the lock in a particular specific orientation. That is, the guide projection 416*a* may prevent insertion of the key 410 unless the guide channel 416*c* is aligned with the guide projection 408*a*. As the guide projection 408*a* first engages the guide channel 416*c*, rotation of the key may be inhibited while axial movement of the key is permitted. Accordingly, in some embodiments, the key 410 must be fully inserted into the insertion channel before the guide projection 408*a* disengages from guide channel 416*c* and rotation of the key is permitted. In other embodiments, the key may not need to be fully inserted in order for rotation of the key to be permitted.

Figure 17:
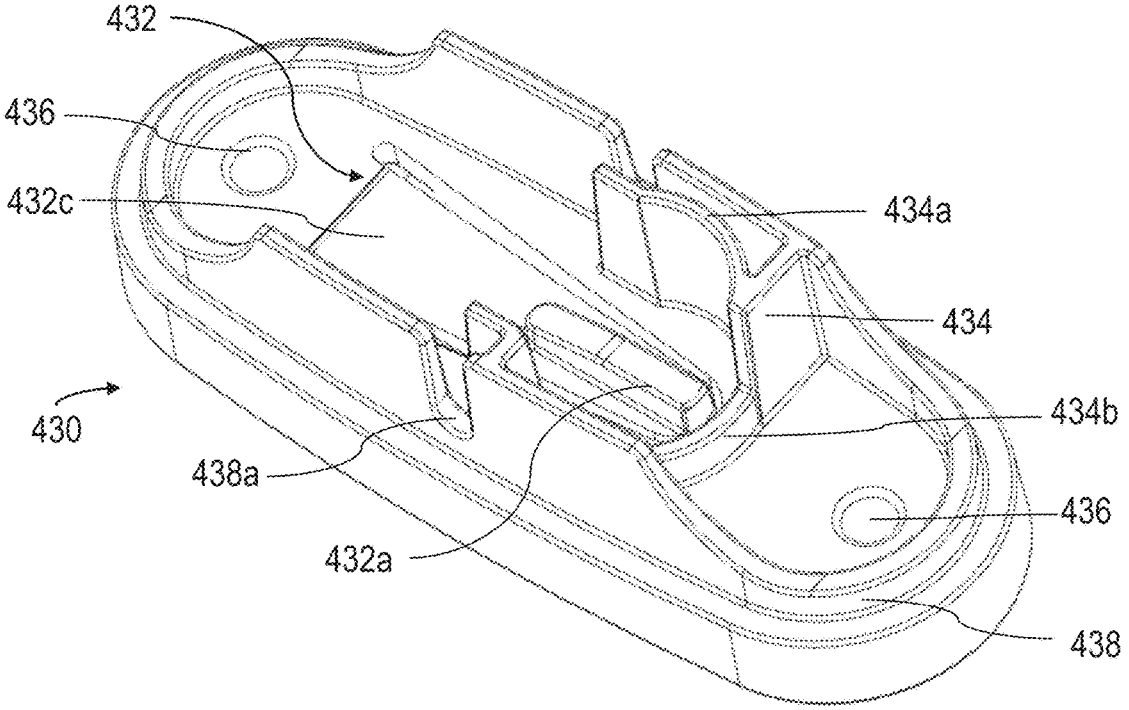
FIG. 17 is a perspective view of one embodiment of a base including a blocker and a bending member for use with the lock of FIG. 10.
Figure 18:
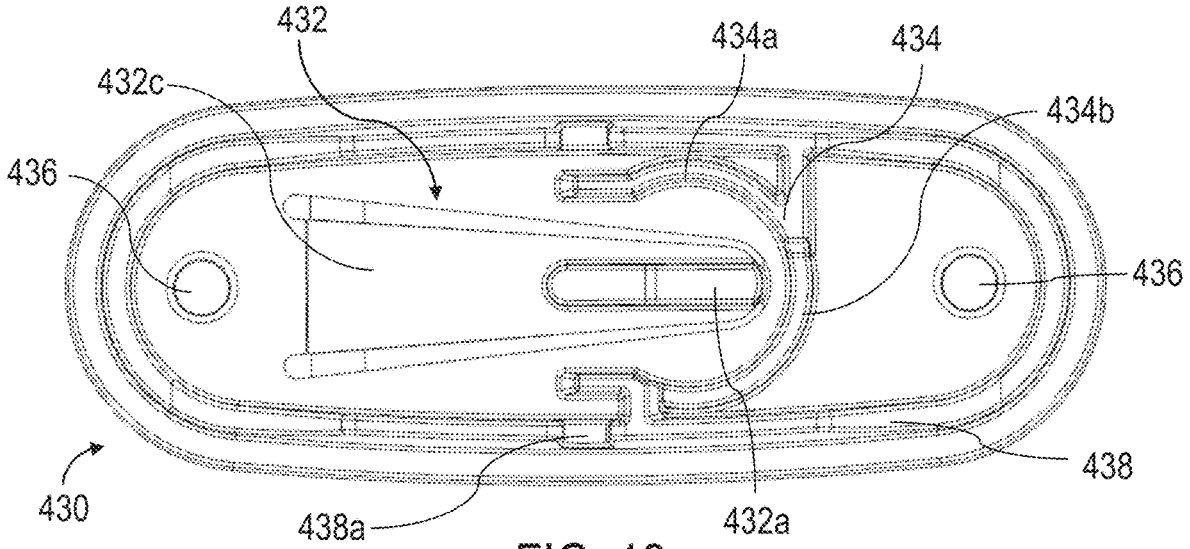
FIG. 18 is a top view of the base of FIG. 17.

As shown in FIGS. 11 and 17-18, the base 430 of the lock 400 includes a blocker 432. The blocker includes a blocking projection 432*a* mounted on a bending member 432*c*. As discussed previously, the blocker is arranged to move between a blocking position and an unblocking position using the bending member 432*c*. In the blocking position, the blocker is arranged to engage the blocking recess 428 on the locking unit 420 to inhibit movement of the locking unit between the locking position and the unlocking position. The blocking recess 428 is formed in a cross shape, such that a first portion 428*a* of the blocking recess is perpendicular to a second portion 428*b* of the blocking recess. In the embodiment depicted in FIG. 11, the first portion 428*a* engages the blocking projection 432*a* when the locking unit is in the locking position and the blocker 432 is in the blocking position. The second portion 428*b* engages the blocking projection 432*a* when the locking unit is in the unlocking position and the blocker is in the blocking position. Accordingly, the blocker 432 engages the locking unit 420 in both the locking and unlocking positions such that two actions must be used to either lock or unlock the lock. In the embodiment depicted in FIG. 11, the locking unit rotates ninety degrees between the locking position and the unlocking position.

Figure 12:
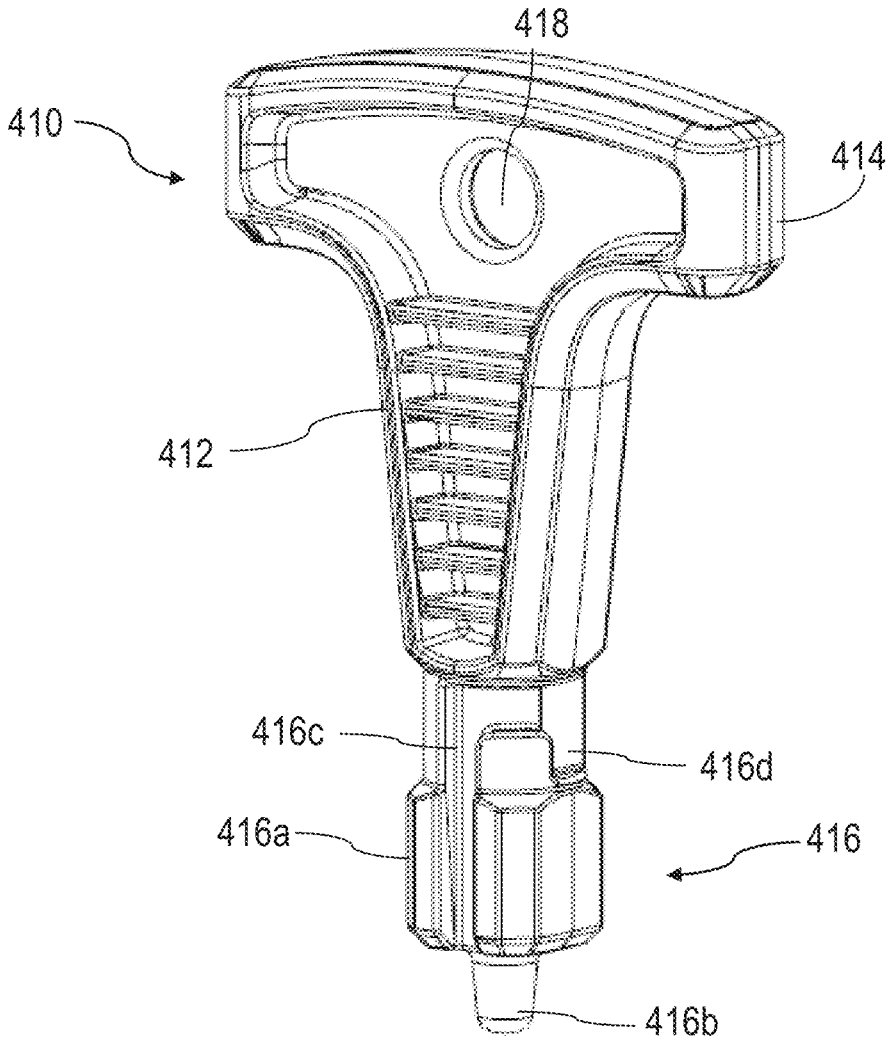
FIG. 12 is a perspective view of one embodiment of a key for use with the lock of FIG. 10.
Figure 13:
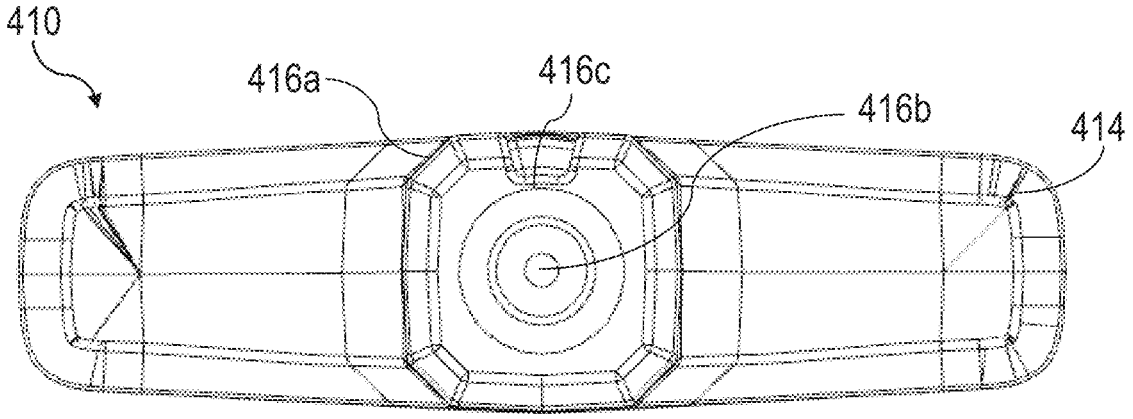
FIG. 13 is a bottom view of the key of FIG. 12.

FIGS. 12 and 13 are a perspective view and a bottom view, respectively, of one embodiment of the key 410 for use with the lock of FIG. 10. The key includes a shaft 412, a handle 414, an insertion end 416, and a hole 418. The shaft 412 and the handle 414 are adapted to transmit axial and rotational forces to the locking unit of the lock. The handle is adapted to be manipulated by an operator so that the operator may reliably apply axial force and torque to the key, while the shaft is arranged to transmit the forces which are applied to the handle to the insertion end. The hole is arranged such that the key may be placed on a keychain or other conventional key storage device.

The insertion end of the key includes an outer surface 416*a*, an end projection 416*b*, a guide channel 416*c*, and a retaining channel 416*d*. As discussed previously, the outer surface 416*a* is arranged to complement an internal channel of a locking unit, such that torque may be transmitted between the key and the locking unit. The end projection 416*b* is adapted to transmit axial force from the key to the blocker of the lock to move the blocker from a blocking position to an unblocking position. As shown in FIGS. 12 and 13, the end projection is radially smaller than the outer surface such that the internal channel may be an axial stop for the key to stop additional axial (e.g., insertion) motion of the key once the key is fully inserted. That is, the internal channel of the locking unit may taper (for example, see FIGS. 14-16) so that the end projection may protrude out of the locking unit to move the blocker while the outer surface 416*a* abuts the internal channel and prevents further axial insertion of the key.

The guide channel 416*c* is arranged to engage the guide projection disposed on the housing of the lock such that the key is reliably inserted into the lock in a predetermined orientation. According to the embodiment shown in FIG. 12, the guide channel extends the length of the insertion end 416 such that the key must be fully inserted into the lock before the key is able to rotate. In some embodiments, full insertion of the key corresponds to a position where the end projection 416*b* applies force to the blocker and has moved the blocker to an unblocking position. Both the blocker and the guide channel 416*c* prevent rotation of the key prior to axial motion of the key to reinforce the dual-action mechanism of the lock.

The retaining channel 416*d* is spaced from the guide channel 416*c* such that rotation of the key when the key is fully inserted in the lock moves the guide projection into the retaining channel. As shown in FIG. 12, the retaining channel is formed on an upper portion of the insertion end and does not extend the entire length of the insertion end 416. Accordingly, the guide projection is captured inside of the retaining channel 416*d* when the key is rotated and subsequently moved in a withdrawing direction to prevent further withdrawal of the key. The retaining channel 416*d* may be arranged with a suitable depth such that the blocker including a biased member (e.g., a bending member) may move the key in the withdrawal direction until the blocker is in the blocking position. In such an arrangement the guide projection is automatically captured in the retaining channel once the key is rotated and force is removed from the key. Thus, the retaining channel is adapted to retain the key in the lock when the locking unit is in either a locking position or an unlocking position. According to the embodiment depicted in FIG. 12, the retaining channel is arranged to retain the key in the lock when the locking unit is in the unlocking position.

Figure 14:
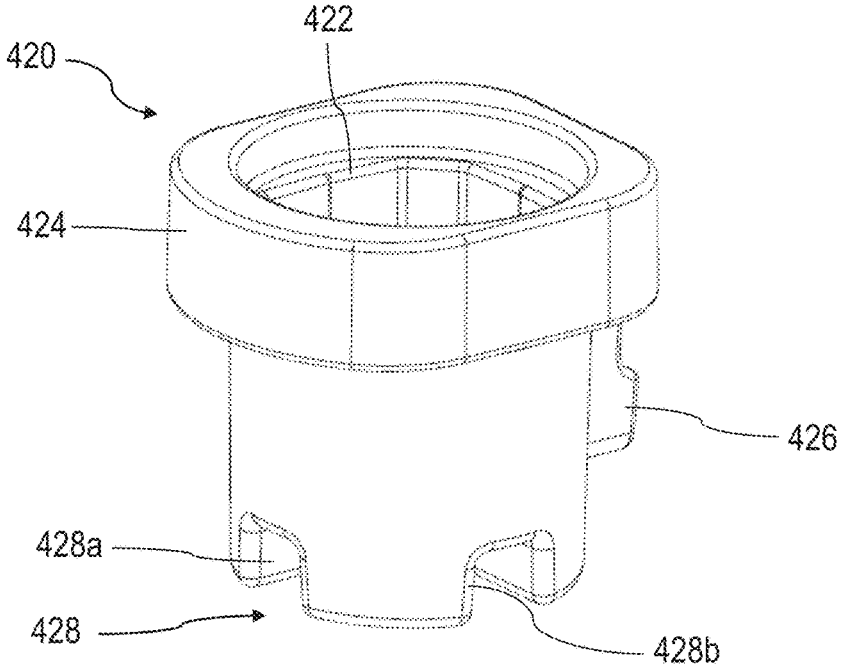
FIG. 14 is a perspective view of one embodiment of a locking unit for use with the lock of FIG. 10.
Figure 15:
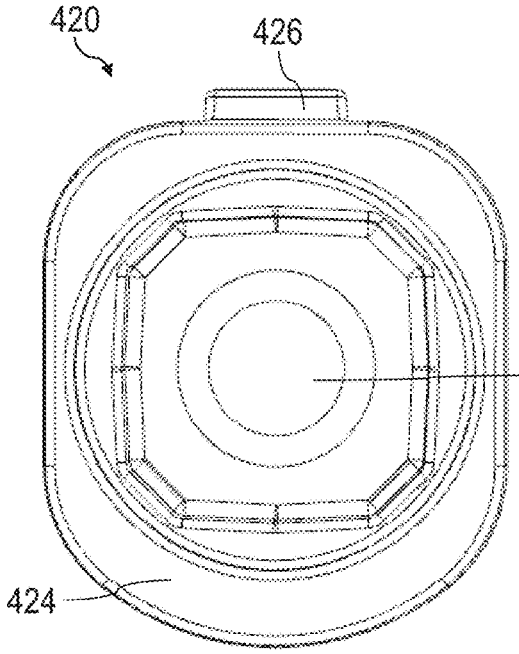
FIG. 15 is a top view of the locking unit of FIG. 13.
Figure 16:
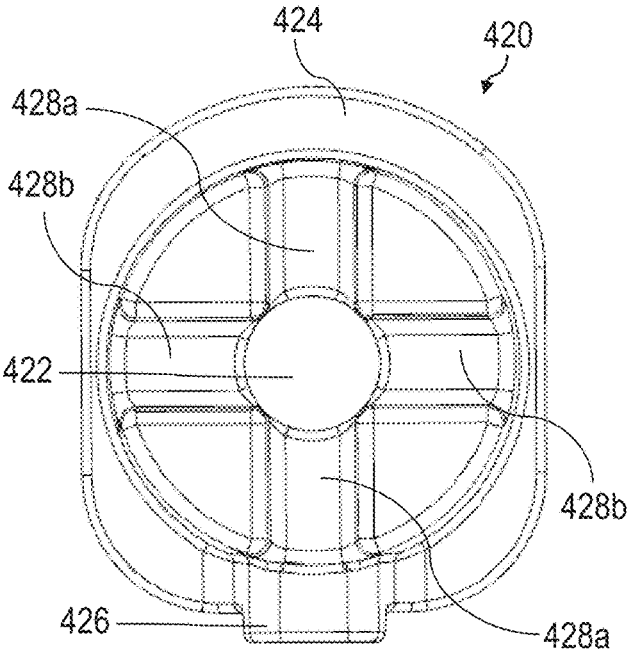
FIG. 16 is a bottom view of the locking unit of FIG. 13.

FIGS. 14, 15, and 16 are a perspective view, top view, and bottom view, respectively, of one embodiment of a locking unit 420 for use with the lock of FIG. 10. The locking unit includes an internal channel 422, a locking projection 424, a guide 426, and a blocking recess 428. As best seen in FIGS. 15 and 16, the internal channel 422 extends through the entire length of the locking unit such that an inserted key may project out of both ends in some embodiments. The internal channel tapers towards the bottom of the locking unit so that the internal channel prevents additional axial (e.g., insertion) movement of the key once the key is fully inserted. The locking projection 424 is arranged to be received by a retaining recess in the tether insert so that the locking unit resists pulling forces on the tether insert which would otherwise remove the insert from the lock. The guide 426 is arranged to contact supporting components on the housing and base of the lock to facilitate consistent movement of the locking unit between the locking position and the unlocking position.

According to the embodiment depicted in FIGS. 14-16, the blocking recess 428 includes a first portion 428*a* and a second portion 428*b*. Taken together, the first portion and second portion form a cross shape in the bottom of the locking unit as best seen in FIG. 16. The first portion and second portion are arranged perpendicular to one another, with the first portion 428*a* aligned with the locking projection 424. The first portion and second portion of the blocking recess are each arranged to receive the blocker when the locking unit is in the locking position and the unlocking position, respectively. That is, in the embodiment depicted in FIGS. 14-16, the locking position and unlocking position are offset by an approximately ninety degree rotation. Thus, the blocker is biased to move toward the blocking position to engage the blocking recess when the locking unit is in either the locking or unlocking position to prevent rotation of the locking unit unless the blocker is moved to the unblocking position using the key.

FIGS. 17-18 are a perspective view and top view, respectively, of one embodiment of a base 430 including a blocker 432 with a bending member 432*c* for use with the lock of FIG. 10. The blocker 423 includes a blocking projection 432*a* mounted on the bending member 432*c*. As shown in FIGS. 17-18, the blocker is in the blocking position and the bending member is substantially straight. In the unblocking position the blocker is pushed downward with the key such that the bending member bends and the blocking projection moves out of engagement with the blocking recess on the locking unit. The blocking projection 432*a* is formed such that it complements the shape of the first portion and the second portion of the blocking recess and inhibits rotation of the locking unit when engaged with either of said blocking recess portions.

As shown in FIGS. 17-18 and discussed previously, the base may include a guide wall 434 arranged to receive the locking unit and facilitate reliable movement of the locking unit between the locking position and the unlocking position. As shown in FIGS. 17-18, the guide wall may include a high portion 434*a* and a low portion 434*b*. The low portion 434*b* is arranged to contact the locking unit guide, and the high portion 434*a* is arranged to support the locking unit on the locking unit sides to allow for consistent rotation of the locking unit between the locking portion and the unlocking position.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. A window lock comprising:

a rotatable locking unit constructed and arranged to rotate between a locking position and an unlocking position;

a blocker having a blocking surface which is configured to prevent rotation of the locking unit from the locking position to the unlocking position when the blocker is in a blocking position; and a key that is axially insertable into the locking unit, wherein:

the key is constructed and arranged to travel within the locking unit in an axial direction of the key and apply a force to the blocker in the axial direction to push the blocker out of the blocking position; and with the blocker out of the blocking position, the blocker is positioned outside of the locking unit, and the blocking surface is not positioned to prevent rotation of the locking unit from the locking position to the unlocking position; and the key and the locking unit are adapted such that rotation of the key rotates the locking unit.

2. The window lock of claim 1, further comprising a housing, wherein the locking unit and blocker are positioned in the housing.

3. The window lock of claim 2, further comprising a tether, wherein the locking unit is adapted to secure the tether to the housing when the locking unit is in the locking position and release the tether from the housing when the locking unit is in the unlocking position.

4. The window lock of claim 3, wherein the tether comprises an insert adapted to be attached to the housing, and the rotatable locking unit is arranged to prevent release of the insert from the housing when the rotatable locking unit is in the locking position, and the rotatable locking unit is arranged to permit release of the insert from the housing when the locking unit is in the unlocking position.

5. The window lock of claim 1, wherein the key comprises at least three faces arranged on an outer circumference of the key, and the at least three faces are arranged to contact the locking unit to rotate the locking unit between the locking position and the unlocking position.

6. The window lock of claim 1, wherein the blocker is positioned on a bending member, and the key is constructed and arranged to bend the bending member via axial movement of the key within the locking unit.

7. The window lock of claim 1, wherein the key includes an insertion end, and the insertion end passes all the way through and extends out of the locking unit.

8. The window lock of claim 1, wherein the key includes a retaining channel adapted to retain the key in the locking unit when the locking unit is in the unlocking position.

9. The window lock of claim 1, wherein the blocking surface is configured to prevent rotation of the locking unit from the unlocking position to the locking position when the blocker is in the blocking position.

10. The window lock of claim 1, wherein the locking unit includes a key stop adapted to stop the travel of the key in the axial direction when the blocker is out of the blocking position.

11. A lock comprising:

a locking unit constructed and arranged to rotate between a locking position and an unlocking position;

a blocker positioned on a bending member, the blocker having a blocking surface which is configured to prevent rotation of the locking unit from the locking position to the unlocking position when the blocker is in a blocking position, and wherein the bending member is cantilevered; and a key constructed and arranged to be inserted into the locking unit, wherein:

the key is constructed and arranged to push at least one of the blocker and bending member to bend the bending member and move the blocker out of the blocking position.

12. The lock of claim 11, wherein the lock is a window lock.

13. The window lock of claim 12, wherein the locking unit is constructed and arranged to rotate between the locking position and the unlocking position.

14. The window lock of claim 12, further comprising a housing, wherein the locking unit and blocker are positioned in the housing.

15. The window lock of claim 14, further comprising a tether, wherein the locking unit is adapted to secure the tether to the housing when the locking unit is in the locking position and release the tether from the housing when the locking unit is in the unlocking position.

16. The window lock of claim 15, wherein the tether comprises an insert adapted to be attached to the housing, and the locking unit is arranged to prevent release of the insert from the housing when the locking unit is in the locking position, and the locking unit is arranged to permit release of the insert from the housing when the locking unit is in the unlocking position.

17. The window lock of claim 12, wherein the key comprises at least three faces arranged on an outer circumference of the key, and the at least three faces contact the locking unit to move the locking unit between the locking position and the unlocking position.

18. The window lock of claim 12, wherein the key is constructed and arranged to bend the bending member via axial movement of the key within the locking unit.

19. The window lock of claim 12, wherein the key includes an insertion end, and the insertion end passes all the way through and extends out of the locking unit.

20. The window lock of claim 12, wherein the key is constructed and arranged to push the blocker to bend the bending member and move the blocker out of the blocking position.

21. The window lock of claim 12, wherein the key includes a retaining channel adapted to retain the key in the locking unit when the locking unit is in the unlocking position.

22. The window lock of claim 12, wherein the blocking surface is configured to prevent rotation of the locking unit from the unlocking position to the locking position when the blocker is in the blocking position.

23. The window lock of claim 12, wherein the locking unit includes a key stop adapted to stop the travel of the key in an axial direction of the key when the blocker is out of the blocking position.

24. A window lock comprising:

a rotatable locking unit constructed and arranged to rotate between a locking position and an unlocking position;

a blocker having a blocking surface which is configured to prevent rotation of the locking unit from the locking position to the unlocking position when the blocker is in a blocking position; and a key including a retaining channel that is insertable into the locking unit, the key including an insertion end, wherein:

the insertion end is constructed and arranged to apply a force to the blocker to move the blocker out of the blocking position, and the insertion end is constructed and arranged to pass all the way through and extend out of the locking unit; and with the blocker out of the blocking position the blocker is positioned outside of the locking unit, and the blocking surface is not positioned to prevent rotation of the locking unit from the locking position to the unlocking position; and the key and the locking unit are adapted such that rotation of the key rotates the locking unit; and the retaining channel retains the key in the locking unit when the locking unit is in the unlocking position.

25. The window lock of claim 24, further comprising a housing, wherein the locking unit and the blocker are positioned in the housing.

26. The window lock of claim 25, further comprising a tether, wherein the locking unit is adapted to secure the tether to the housing when the locking unit is in the locking position and release the tether from the housing when the locking unit is in the unlocking position.

27. The window lock of claim 26, wherein the tether comprises an insert adapted to be attached to the housing, and the rotatable locking unit is arranged to prevent release of the insert from the housing when the rotatable locking unit is in the locking position, and the rotatable locking unit is arranged to permit release of the insert from the housing when the locking unit is in the unlocking position.

28. The window lock of claim 24, wherein the key comprises at least three faces arranged on an outer circumference of the key, and the at least three faces are arranged to contact the locking unit to rotate the locking unit between the locking position and the unlocking position.

29. The window lock of claim 24, wherein the blocker is positioned on a bending member, and the key is constructed and arranged to bend the bending member via axial movement of the key within the locking unit.

30. The window lock of claim 24, wherein the blocking surface is configured to prevent rotation of the locking unit from the unlocking position to the locking position when the blocker is in the blocking position.

31. The window lock of claim 24, wherein the locking unit includes a key stop adapted to stop the travel of the key in an axial direction of the key when the blocker is out of the blocking position.

32. The lock of claim 11, further comprising a base, wherein the bending member is cantilevered from the base.

* * * * *